United States Patent [19]

Abendroth et al.

[11] Patent Number: 5,025,723

[45] Date of Patent: Jun. 25, 1991

[54] DRIVE FOR THE ROTATION AND LATERALLY RECIPROCATING DISTRIBUTING ROLLER IN INKING OR DAMPING UNITS

[75] Inventors: Paul Abendroth, Offenbach am Main; Herbert Rebel, Rodgau, both of Fed. Rep. of Germany

[73] Assignee: MAN Roland Druckmaschinen AG, Fed. Rep. of Germany

[21] Appl. No.: 553,101

[22] Filed: Jul. 13, 1990

[30] Foreign Application Priority Data

Jul. 14, 1989 [DE] Fed. Rep. of Germany ..... 3923315

[51] Int. Cl.[5] ..... B41F 7/26; B41F 31/14

[52] U.S. Cl. ..... 101/148; 101/349; 101/DIG. 38

[58] Field of Search ..... 101/DIG. 38, 348, 349, 101/351, 148, 354, 355, 323, 325, 302, 304, 305, 307-309, 311, 312, 313, 314

[56] References Cited

U.S. PATENT DOCUMENTS 4,397,236 8/1983 Greines et al. ..... 101/DIG. 38
4,796,530 1/1989 Etchell ..... 101/349

FOREIGN PATENT DOCUMENTS 484650 10/1929 Fed. Rep. of Germany .
41474 9/1965 Fed. Rep. of Germany .

*Primary Examiner*—J. Reed Fisher
*Attorney, Agent, or Firm*—Leydig, Voit & Mayer

[57] ABSTRACT

A drive for rotating and reciprocating a distributing roller in inking or damping units of offset printing presses includes two gears rotating at different speeds from one another, only the first rotation-transmitting gear of the two gears is driven by a gear connected to the plate cylinder and the second lateral reciprocation-transmitting gear is driven by the first gear by way of an intermediate gear meshing with both gears.

1 Claim, 2 Drawing Sheets

DRIVE FOR THE ROTATION AND LATERALLY RECIPROCATING DISTRIBUTING ROLLER IN INKING OR DAMPING UNITS

FIELD OF THE INVENTION

The invention relates generally to damping units of offset printing presses and more specifically concerns drives for the rotating and laterally reciprocating distributing rollers of a damping unit.

BACKGROUND OF THE INVENTION

Generally, three drives are superimposed on the generated surface of a distributing roller in inking or damping units of offset printing presses. First there is the positive drive of the distributing roller by a transmission, more particularly a geared transmission, which is responsible for the rotation of the distributing roller, second there is the positive drive for lateral reciprocation of the roller and third there is the friction drive produced by the pressure with which the distributing roller cooperates with contiguous rollers.

A drive such as described above is generally disclosed in DD-PS 41 474 and according to this disclosure the drive has a loose gear which transmits the lateral reciprocation to the distributing roller and this loose gear has two teeth less than the gear which transmits rotation to the distributing roller, the latter gear being rigidly connected to a bearing extension of the distributing roller. The loose gearwheel is connected by a pin with a roller to a circular cam groove in a sleeve, which is rigidly connected to the bearing extension, the pin being disposed in the hub of the loose gear. When the loose gear having two teeth less than the other gear rotates, the pin and roller in the hub are driven with acceleration circularly in the cam groove, resulting in the sleeve with the bearing extension and, therefore, the distributing roller being reciprocated once by the distance of the pitch of the cam groove relative to the number of teeth of the loose gear and of the rotation-transmitting gear.

When the pin with the roller experiences accelerated circular engagement with respect to the cam groove, the loose gear experiences vibrations emanating from the press, for example, from the drive gear train of the printing cylinder and/or from the friction drive of the rollers and cylinder with the rotary vibrations and/or distributing vibrations deriving from the plate cylinder recess as the inking rollers run on and off and due to the possibility of the inking rollers being driven with peripheral slip. Also, the loose gear experiences vibrations arising from the derivation of the cyclic traversing movement of the distributing roller from a rotary movement of the cam groove with the roller entrained therein with acceleration in the circular groove, the roller being rigidly connected by way of the pin to the hub of the loose gear.

The loose gear is relatively light in weight and so its moment of inertia is inadequate to damp the vibrations which are superimposed on one another. Additionally, since the loose gear is rigidly connected to a gear of the drive gear train from the printing unit rollers, the vibrations of the loose gear are transmitted without damping as far as the printing rollers. Thus, this kind of drive entails a risk of the formation of gear tooth striping on the print support, as a result of play between tooth flanks due to the undamped vibrations of the loose gear.

OBJECTS AND SUMMARY OF THE INVENTION

It is the primary object of the invention to improve the stability of the drive for the rotating and reciprocating movement of a distributing roller in order to provide a clean print image which is free from gear tooth striping.

According to the present invention, a drive is provided for the rotating and reciprocating movement of a distributing roller in inking or damping units of offset printing presses by means of two gears rotating at different speeds to one another, the first gear transmitting rotation while the second gear transmits lateral reciprocation to the distributing roller. The first gear is in rigid driving engagement with a circular cam groove while the hub of the second gear carries a pin having a roller entrained and driven with acceleration in the circular cam groove. The first gear is driven by a gear connected to the plate cylinder of the offset printing press while the second gear is driven by the first gear by way of an intermediate gear meshing with both gears.

The advantage of the invention is that the movement of the second gear with its pin and roller is driven in series from the gear which transmits the rotating movement to the distributing roller. Consequently, possible vibrations of the distributing roller are damped due to the interposition of the moment of inertia of the entire damping unit drive, thus making it possible to preclude the quality-impairing gear tooth striping of the sheet being printed.

These and other features and advantages of the invention will become more apparent from the following detailed description when taken in conjunction with the accompanying drawings.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
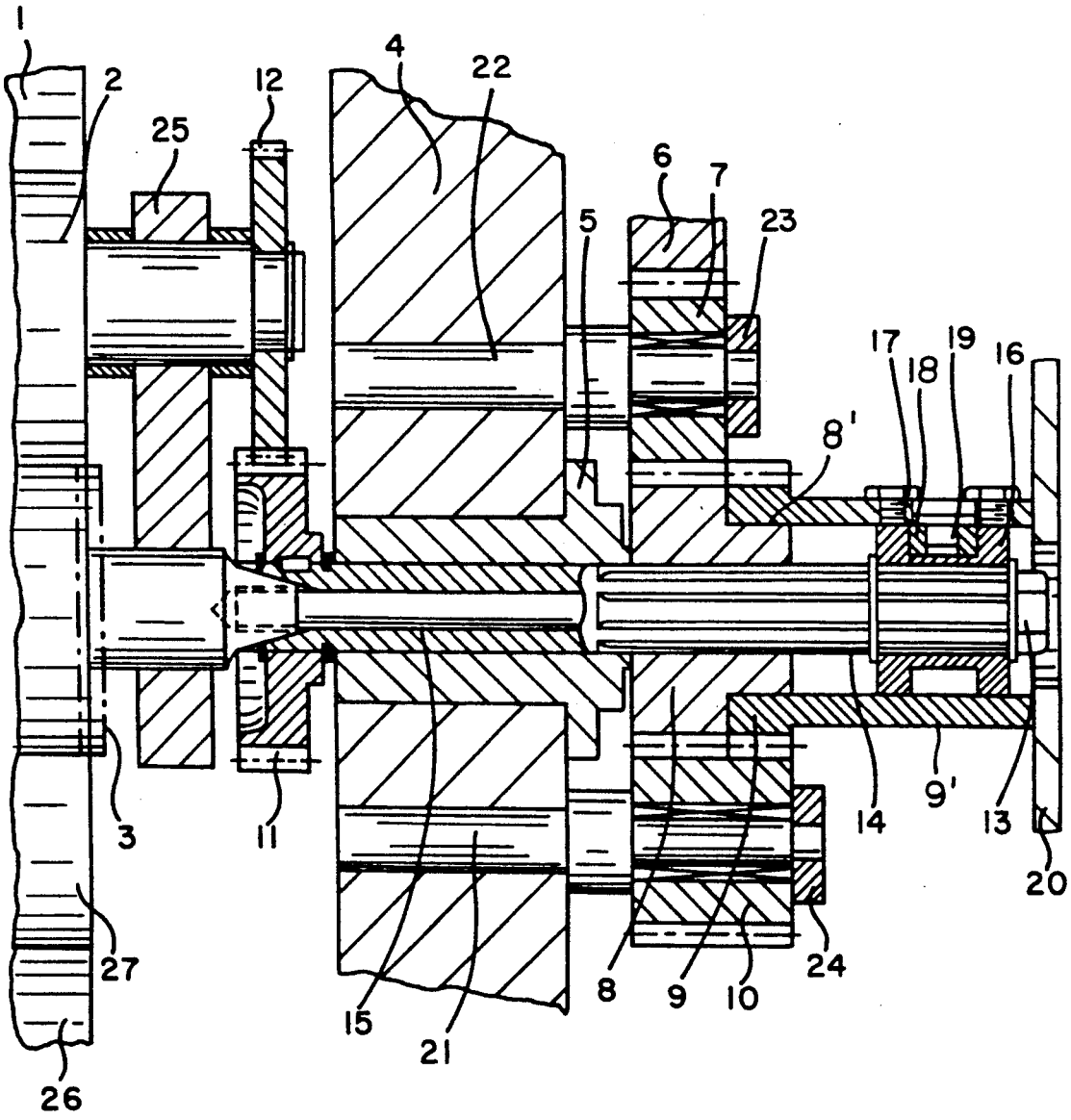
FIG. 1 is a section in partly diagrammatic view of a damping unit with the distributing roller drive.
Figure 2:
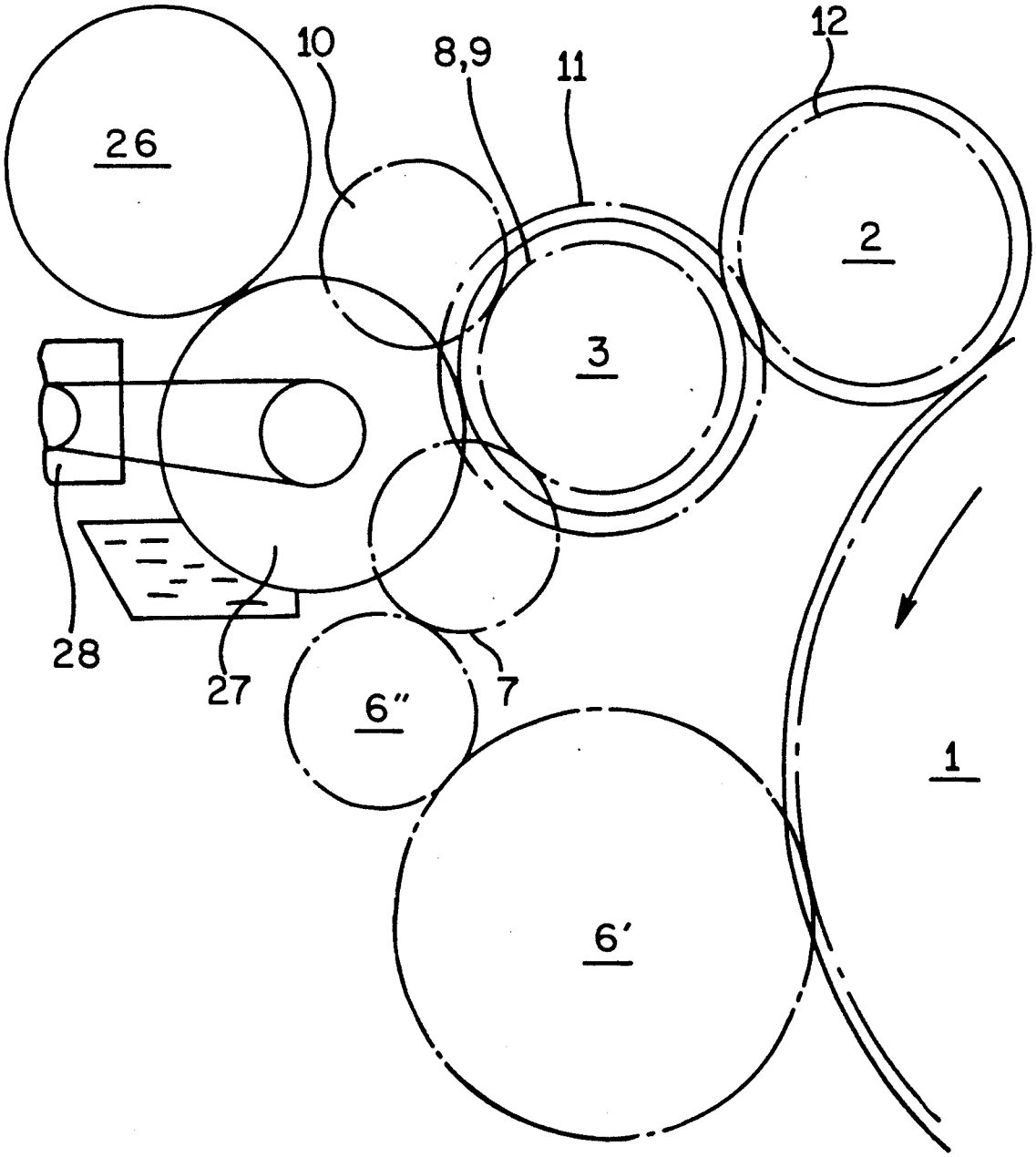
FIG. 2 is a schematic side view of the damping unit shown in FIG. 1.

Turning now to the drawings, FIG. 2 shows a damping unit for an offset printing press. The damping unit comprises an inking roller 2, a distributing roller 3, an intermediate roller 26 and a ductor roller 27. The inking roller 2 is in contact with a plate cylinder 1 of the printing press and with the distributing roller 3. The inking roller 2 is driven off the distributing roller 3 by a gear 12, the drive being by way of a gear 11. Consequently, depending upon the transmission ratio selected, the drive of the inking roller 2 may or may not be synchronous relatively to the plate cylinder 1 and is positive since it is by way of a rigid driving connection to the distributing roller 3. The inking roller 2 is mounted in bearing levers 25 mounted for pivoting around the axis of the distributing roller 3 as shown in FIG. 1.

Additionally, the non-movably mounted distributing roller 3 is also in contact with the ductor roller 27. The ductor roller dips into a duct of liquid and, by contact with a metering roller 26, transmits a thin film of damping liquid to the distributing rollers. The ductor roller 27 is also non-movably mounted and is driven by a variable-speed geared motor 28. The intermediate roller 26 is, similarly to the inking roller 2, mounted for pivoting around a pivot fixed to the frame in bearing levers (not shown). It will be understood that the adjustment of the rollers relative to one another and their moving into and out of engagement with one another is performed in a conventional manner as disclosed in the prior art and will therefore not be described in greater detail.

In accordance with the present invention, the distributing roller 3 is driven positively by a drive gear 7 driven either directly, or by way of intermediate gears 6' and 6'', by a gear 6 secured to the plate cylinder 1. The transmission ratio is such that the distributing roller 3 rotates at the angular velocity of the plate cylinder 1. The transmission ratio in the drive of the inking roller 2 by the distributing roller 3 can be unity so that there is no slip between the rollers 2 and 3 or the transmission ratio can be such that there is slip between the rollers 2 and 3 wherein the latter rollers run asynchronously.

In the illustrated embodiment, a hollow driving bearing extension 15 of the distributing roller 3 is connected by a screw 13 and a cone to the drive journal of the distributing roller 3 so that the bearing extension 15 can be removed from the press together with its mounting and the drive elements. The bearing extension 15 is guided in a bearing lining 5. Additionally, by way of a splined section member 14, the extension 15 is connected to a gear 8, which transmits the rotation for the distributing roller 3 and the extension 15.

According to the invention, a loose gear 9 transmitting the lateral reciprocation of the distributing roller 3 is connected to a circular cam groove 17 in a sleeve 16 by way of a pin 19 and a roller 18. The sleeve 16 is rigidly connected by discs to the extension 15 which thus transmits the lateral reciprocation to the distributing roller 3. Pursuant to one important feature of the invention, the rotation of the loose or second gear 9, which transmits lateral reciprocation to the distributing roller 3, is produced by way of an intermediate gear 10 which meshes only with the gear 9 and with the first gear 8, which transmits the rotation to the distributing roller 3 as shown in FIG. 2. The rotation of the first gear 8 is produced by way of a gear 7 and a gear 6'' of the positive rotary drive of the press. Thus, the gear 7 meshes only with the gear 6'' and with the first gear 8.

Consequently, the loose gear 9, transmitting lateral reciprocation to the roller 3, and the first gear 8 fixed on the bearing extension 15 of the roller 3, mesh with the gear 10. The first gear 8 transmits its rotation by way of the common gear 10 to the loose gear 9 which has two teeth less than the gear 8. As a result, since the gear 9 rotates with improved stability because of the interposition of the moment of inertia of the damping unit, the pin 19 disposed in the hub 9 of the loose gear 9 is stabilized and is entrained with acceleration in the circular cam groove 17 in the sleeve 16 with reduced vibration. The sleeve 16 with the bearing extension 15 is therefore reciprocated once, with reduced vibration, by the distance of the cam pitch of the groove 17 in relation to the tooth number and rotations of the first gear 8.

It will be appreciated that the lateral drive of the distributing roller 3 is therefore not in parallel but in series with the rotating drive of the roller 3, such drive being derived from the plate cylinder drive by way of gears 6 and 7 whereas the rotation of the loose or second gear 9, transmitting the lateral reciprocation, is derived from the first gear 8. With the forces flowing in this manner to reduce the vibrations of the loose gear 9 in the drive of the distributing roller 3, tooth flank change can be precluded despite the presence of between-teeth air at different contact pressures of the rollers 1, 2 and 3, and despite any differences in circumferential speeds and circumferential slip and difficulties arising from the plate cylinder recess, so that quality-impairing gear tooth striping due to drive-initiated vibrations does not occur on the printed sheet.

For the sake of completeness, it should be further mentioned that the loose gear 9 rotating on the hub 8 of the fixed gear 8 bears on an axial support 20 while the fixed first gear 8 bears axially on the bearing lining 5. Also, the two gears 7, 10 are rotatably mounted on respective bearing pins 21, 22 mounted in the frame wall 4 of the press, the gears 7, 10 being secured axially by respective adjusting rings 23, 24 as shown in FIG. 1.

From the foregoing, it will be understood that the present invention provides a drive for the rotating and reciprocating movement of a distributing roller by means of two gears rotating at different speeds from one another. The first gear transmitting the rotation is driven by a gear connected to the plate cylinder while the loose or second gear for transmitting the lateral reciprocation to the roller is driven through an intermediate gear by the first gear which results in reduced vibration of the second gear.

We claim as our invention:

1. A drive for rotating and reciprocating a distributing roller in an inking or dampening unit of an offset printing press comprising:

a plate cylinder;

a distributing roller having a shaft;

means for mounting said distributing roller for rotational and axial reciprocation;

a gear connected to said plate cylinder for providing a drive input for rotating said distributing roller;

a first gear and a second gear having different numbers of gear teeth thereon;

means including said different numbers of gear teeth for rotating said first gear and second gear at different rotational speeds relative to one another;

means including a hub on said first gear for mounting said first gear on the shaft of said distributing roller and for transmitting rotational movement thereto while allowing for axial sliding engagement thereon;

said second gear being freely rotatably mounted on the hub of the first gear and disposed to transmit lateral reciprocation to said distributing roller;

a circular cam groove mounted on the shaft of said distributing roller;

said first gear being in rigid driving engagement with said circular cam groove by way of said distributing roller shaft;

said second gear being in rigid driving engagement with a pin having a cam roller disposed for angular acceleration in said circular cam groove, said first gear being driven by said gear connected to said plate cylinder, an intermediate gear mounted for meshing engagement with both said first gear and said second gear;

and wherein only said first gear of said first and second gears rotating at different speeds from one another is driven directly by said gear connected to said plate cylinder and said second gear is driven only by said first gear by way of said intermediate gear meshing with both said first gear and said second gear.

* * * * *